United States Patent [19]

Bushnell et al.

[11] 4,057,491

[45] Nov. 8, 1977

[54] SOLVENT RECOVERY PROCESS FOR N-METHYL-2-PYRROLIDONE IN HYDROCARBON EXTRACTION

[75] Inventors: James D. Bushnell, Berkeley Heights; Milton D. Leighton, Florham Park; Thomas M. McDonald, Califon, all of N.J.

[73] Assignee: Exxon Research & Engineering Co., Linden, N.J.

[21] Appl. No.: 670,887

[22] Filed: Mar. 26, 1976

[51] Int. Cl.[2] ..... C10G 21/16

[52] U.S. Cl. ..... 208/321; 203/14; 203/49; 203/82; 208/326

[58] Field of Search ..... 208/321, 326

[56] References Cited

U.S. PATENT DOCUMENTS

| | | | |
|---|---|---|---|
| 2,111,822 | 3/1938 | Sullivan | 208/321 |
| 2,167,730 | 8/1939 | Smoley | 208/321 |
| 2,687,982 | 8/1954 | Baumann | 208/321 |
| 2,923,680 | 2/1960 | Bushnell | 208/321 |
| 3,461,066 | 8/1969 | Morris et al. | 208/321 |

*Primary Examiner*—Herbert Levine

*Attorney, Agent, or Firm*—Edward M. Corcoran

[57] ABSTRACT

N-methyl-2-pyrrolidone is recovered from the raffinate and extract phases produced by its use in hydrocarbon extraction processes, particularly lube oil extraction, through the use of flash evaporation and/or distillation followed by gas stripping. Water buildup in the recovered solvent is prevented by employing solvent dehydration means in the solvent recovery line after gas stripping. Proper control of process parameters enables the dehydration means to remove excess water without requiring additional heat input to the process.

8 Claims, 1 Drawing Figure

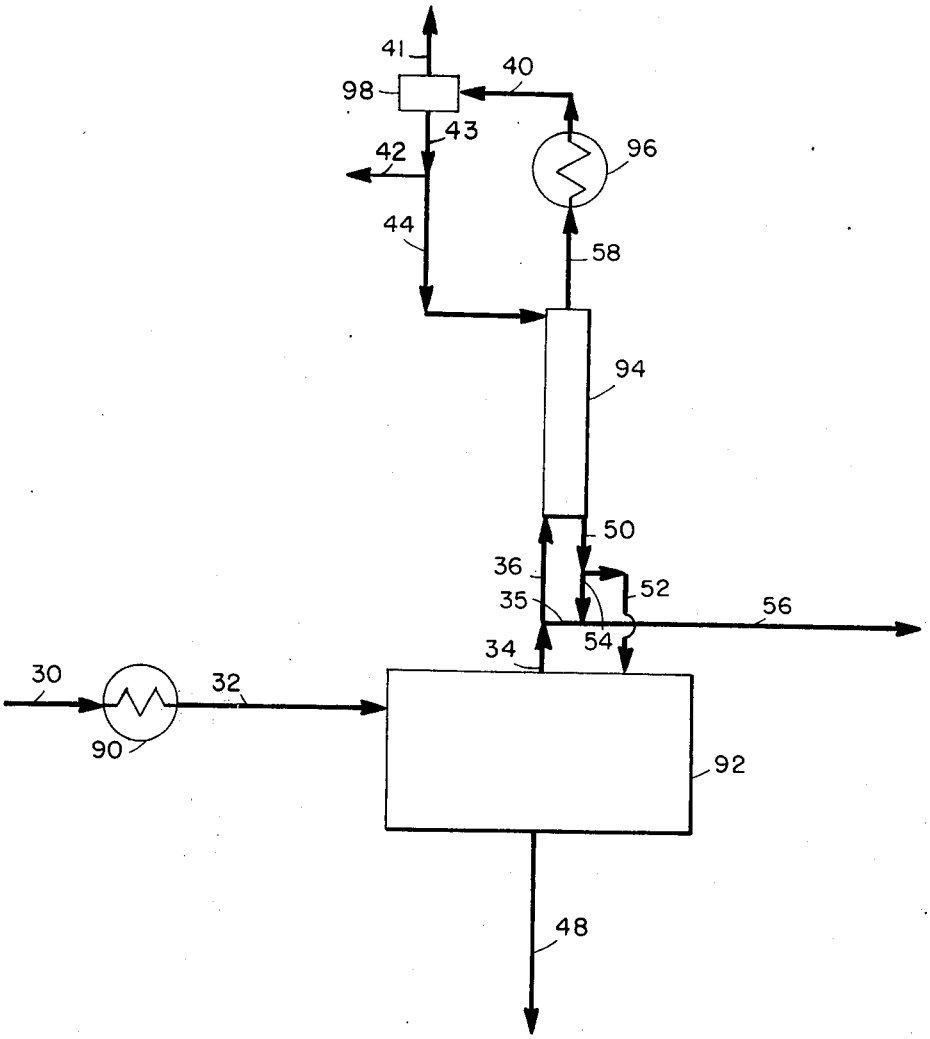
41
40
98
43
42
96
44
58
94
50
36
52
35
56
34
54
30
32
90
92
48

SOLVENT RECOVERY PROCESS FOR N-METHYL-2-PYRROLIDONE IN HYDROCARBON EXTRACTION

BACKGROUND OF THE INVENTION

1. Field of the Invention

This invention relates to the recovery of N-methyl-2-pyrrolidone (hereinafter referred to as NMP for the sake of brevity) employed in hydrocarbon extraction processes and prevents water buildup in the recovered solvent. More particularly, this invention relates to an improved process for removing minor amounts of water extraneously introduced into a lube oil extraction solvent comprising NMP and prevents water buildup in the solvent system. Still more particularly this invention relates to dehydrating said solvent by passing same, as a vapor and in combination with a non-aqueous stripping gas, to a rectification zone and condensing zone, thereby removing the water from the solvent without requiring any additional heat input into the solvent recovery system. 2. Description of the Prior Art It is well known to use NMP as a solvent for extracting aromatic hydrocarbons from mixtures of aromatic and nonaromatic hydrocarbons. It is also well known in the art to use NMP as a lube oil extraction solvent wherein an extraction solvent comprising NMP is contacted with a lube oil fraction thereby extracting the undesirable aromatic and polar constituents from said fraction to produce extract and raffinate phases, the extract phase containing most of the solvent and undesirable lube oil constituents and the raffinate phase containing most of the lube oil.

The purpose of solvent refining lube oil fractions is to remove therefrom those constituents present therein that contribute to low viscosity index, poor thermal stability, poor oxidation stability and poor ultraviolet stability. These constituents are primarily aromatic and polar in nature. Other solvents well known in the prior art as being useful for lube oil extraction include, for example, phenol, phenol-water, furfural, sulfur dioxide, sulfur dioxide-benzyl, chlorex, etc., with the most common solvents being phenol-water and furfural. However, it has recently been found that NMP is somewhat superior to phenol and furfural as a lube oil extraction solvent in that it offers certain advantages such as increased yield of useful lube oils. Another advantage is that it does not form an azeotrope with water as do phenol and furfural, so that mixtures of water and NMP may be completely separated by simple distillation. However, one important disadvantage associated with the use of NMP is the fact that it is highly hygroscopic and absorbs water. This is important, because solvents used in hydrocarbon extraction processes are recovered and reused indefinitely. If water is allowed to build up in these solvents it changes their characteristics.

Adding water to NMP used in solvent extraction processes changes its characteristics in that as more and more water is added to the NMP its solvent power decreases and the solvent/oil miscibility temperature increases. The miscibility temperature is that temperature at which the solvent and oil become mutually soluble or miscible and only one liquid phase exists. In order to obtain the desired yield and quality of raffinate oil at a practicable extraction temperature, it is necessary to maintain the water content of the NMP within an appropriate range. Therefore, critical to the proper use of solvents comprising NMP for lube oil and other hydrocarbon extraction processes is the determination and maintenance of that amount of water that must be added to the solvent for each particular type of hydrocarbon feed. By way of example, when NMP is used to extract a relatively high VI paraffinic lube oil feedstock it preferably contains from 2–4 LV% (liquid volume) of water. As the paraffinicity of the feed decreases, the water content of the NMP can be increased up to as much as 10 LV% or more.

Whatever the optimum water content may be for a particular feedstock or operation, it is necessary to maintain that water content in order to achieve consistent and uniform extraction. However, even though no additional water is deliberately introduced into the solvent, it is possible for water to be accidentally introduced into the solvent and to build up to an undesirable level over a period of time. For example, oil feedstocks often absorb water from humid air while in tankage, steam coils used for heating oils and solvents containing NMP often develop minor leaks, etc. Therefore, in order to avoid changing the characteristics of the NMP-containing extraction solvent over a period of time due to the introduction and buildup of small quantities of extraneous water into the solvent inventory, the extraneously introduced water must be removed in order to maintain the water content at the desired level.

A number of complex solvent recovery schemes have been developed for recovering NMP in lube oil extraction processes. In U.S. Pat. No. 3,476,681 NMP is recovered from the raffinate phase by adding thereto a water-containing stream so as to effect separation of an NMP rich solvent from the raffinate (because NMP is more soluble in water than in oil), distilling and vacuum steam stripping residual NMP and water from the water-extracted oily raffinate phase, distilling the extract from the solvent extraction twice, followed by steam stripping, combining the distillate from both strippers to provide the water containing stream for removing (water extracting) the NMP from the raffinate and then finally separating the water from the NMP by distillation. U.S. Pat. No. 3,461,066 is directed towards a process for removing both NMP and extraneously introduced water from the extract phase of solvent extracted lube oil stocks via four consecutive distillations, resulting in essentially water-free NMP being recycled back to the extraction zone. Similarly, in U.S. Pat. Nos. 3,470,089 and 3,476,680 distillation is the method that is ultimately used for separating the recovered NMP from extraneously introduced water. However, in utilizing distillation for separating water from NMP a considerable amount of heat is required, because water has about five times the latent heat of evaporation as the NMP. Further, any distillation operation requires a heating and cooling cycle.

Therefore, it would be a considerable improvement to the art if a method could be found for removing minor amounts of extraneously introduced water from the NMP without the need for separate distillation units and the additional heating and cooling required to operate them.

SUMMARY OF THE INVENTION

It has now been discovered that in recovering a hydrocarbon extraction solvent comprising NMP from at least an extract phase and wherein said solvent is separated from said phase as a vapor by means which includes non-aqueous gas stripping to produce a mixture of the solvent vapor and stripping gas, the improvement which comprises passing at least a portion of said mixture to a rectifying zone and to a condensing zone thereby removing minor amounts of water extraneously introduced into the solvent. The essence of this invention resides in the fact that the water is removed from the recovered solvent without requiring any additional heat input into the solvent recovery system as would be required if the separated solvent was condensed to the liquid state and then distilled to remove the water. It is understood, of course, that inherent in the operation of the instant invention is the requirement that a hydrocarbon feed be extracted by contacting same with an extraction solvent comprising NMP to produce an extract phase and a raffinate phase and that the solvent is recovered and reused for extraction. Further, although the process of this invention may be applied to the solvent recovered from both the raffinate phase and the extract phase, it is preferably applied at least to the solvent recovered from the extract phase, because it is the extract phase that contains most of the solvent and water.

The extraction solvent comprises NMP, along with minor amounts of water ranging from approximately about 0.5 LV% to about 10 LV% based on the NMP content thereof and may also have admixed therewith substantial quantities of other solvents which are higher boiling than water and which do not form a low boiling azeotrope with water when mixed with NMP. Preferred solvents comprise NMP and 0.5 LV% to 5 LV% water. A particularly preferred solvent for high VI paraffinic lube oil feedstocks is NMP and 2–4 LV% water. Initially, this water would be deliberately added to the solvent in order to achieve the desired solvency characteristics. However, additional water above that desired in the solvent inventory can be and generally is extraneously introduced into the solvent via the solvent itself or the hydrocarbon feedstock; for example, water picked up from humid air in tankage, leaking steam heating coils in storage tanks, etc. In any event, it is this minor amount of extraneously introduced water whose removal is the object of this invention.

Any hydrocarbon feed that has an initial boiling point at least about 100° to 150° F above the boiling point of pure NMP solvent (399° F) is suitable for use with the instant invention. Preferable feedstocks are those common to the petroleum refinery industry, especially lube oil feedstocks. Lube oil feeds comprise petroleum fractions having an initial boiling point of above about 500° F. These fractions include deasphalted oils and/or distillate lube oil fractions boiling within the range of about 600° F and 1050° F (at atmospheric pressure) and contain between about 5 and about 70% (by weight) of polar and aromatic compounds such as substituted benzenes, naphthalenes, anthracenes and phenanthracenes, characterized by having a carbon content typically in the range of $C_{15}$–$C_{50}$. Nonlimiting examples of useful feedstocks include crude oil distillates and deasphalted resids, those fractions of catalytically cracked cycle oils, coker distillates and/or thermally cracked oils boiling above about 600° F and the like. These fractions may be derived from petroleum crude oils, shale oils, tar sand oils, and the like. These fractions may come from any source, such as the paraffinic crudes obtained from Aramco, Kuwait, The Panhandle, North Louisiana, etc., naphthenic crudes such as Tia Juana and Coastal crudes, etc., as well as the relatively heavy feedstocks such as bright stocks having a boiling range of 1050° F+ and synthetic feedstocks derived from Athabasca Tar Sands, etc.

Any suitable means may be used for removing the water containing extraction solvent from the extract phase, as long as the solvent is removed from the extract as a vapor by means which includes non-aqueous gas stripping to produce a mixture of solvent vapor and stripping gas. Illustrative but non-limiting examples include flash evaporation, simple distillation, rectification, gas stripping and combinations thereof. Although the exact method used is not germane to the operation of the instant invention, a preferred method comprises a combination of flash evaporation, rectification and gas stripping. A gas other than steam must be used as the stripping agent. Almost any normally gaseous material that will not react with the oil or solvent may be used as the stripping gas. Illustrative but non-limiting examples include autorefrigerants, relatively low molecular weight hydrocarbons, nitrogen and the like, provided, however, that the gas contains no more than about 6 mole % of water vapor before it is contacted with the extract in the stripping operation. The stripping is done to remove relatively small or residual amounts of solvent from the extract after most of the solvent has been removed therefrom as a vapor by flash evaporation, distillation, etc., and produces a mixture of solvent vapor and stripping gas. This mixture is combined with the rest of the solvent vapor recovered from the extract and a portion thereof is fed to the rectification and condensing zones of the dehydration means or dehydrator to remove water therefrom.

The rectification zone may comprise any type of fractionating column containing bubble cap trays, sieve plates, various types of packing, etc., and provided with either internal or external reflux which fractionates the water vapor from the NMP. In the rectification zone the NMP is condensed to a liquid state and returned to the system, while the stripping gas and water vapor pass through said zone to a condensing zone wherein most of the water vapor is condensed to a liquid state, a portion of which must be returned to the rectification zone as reflux. Uncondensed stripping gas containing some water vapor is withdrawn from the condensing zone and sent to any convenient disposal. The condensing zone may comprise any suitable condensor or heat exchanger.

BRIEF DESCRIPTION OF THE DRAWING

The attached drawing is a flow diagram of a preferred embodiment of a solvent recovery process employing the improvement of the instant invention.

DETAILED DESCRIPTION

Referring to the drawing, a vapor stream comprising nitrogen stripping gas, NMP and water and which may have been partially condensed by upstream heat exchangers (not shown), is passed to condenser 90 via line 30, wherein some of the water and most of the NMP condense to a liquid state. Typically, the amount of water in the vapor will range from about 8 to 16 mole %, the NMP from about 70 to 88 mole % and the stripping gas about 4 to 18 mole %. This vapor stream preferably comprises combined overheads from extract and raffinate solvent recovery towers (not shown) which towers include flash evaporation, rectification and stripping zones. However, the vapor stream fed to the condenser may include only the overheads from the extract solvent recovery tower.

The outlet temperature and pressure of condenser 90 generally ranges from about 250 to 400° F and from 20 to 40 psig. Under these conditions about 95–99.5 mole % of the NMP and 50 to 90 mole % of the water vapor are condensed to the liquid state thereby producing a mixture of liquid and vapor which is then fed to hot solvent drum 92 via line 32. Hot solvent drum 92 operates at the same temperature and pressure as the outlet of condenser 90 and merely serves to separate the condensed liquid from the remaining vapor. Liquid NMP containing from about 6 to 14 mole % water is removed from drum 92 via line 48 and sent to solvent storage or recycled back to the extraction zone (not shown), while the vapors are removed overhead via line 34. The composition of these vapors may range from about 10 to 40 mole % for the water, 3 to 17 mole % for the NMP and from about 50 to 85 mole % for the stripping gas, depending on the temperature, pressure and composition of the vapor entering condenser 90. Typically, if the temperature and pressure of the vapors in line 34 are about 30 psig and 330° F, respectively, and if the composition of the stream in line 30 is 11.9 mole % water, 72.7 mole % NMP and 15.4 mole % nitrogen stripping gas, then the vapors in line 36 will comprise 23.2 mole % water, 11.4 mole % NMP and 65.4 mole % nitrogen stripping gas.

In accordance with the improvement of this invention, at least a portion of the vapor overheads leaving drum 92 via line 34 are passed to rectification zone 94 via line 36. In some cases it may be desirable to pass all of these vapor overheads to zone 94. However, more often this ranges from about 2 to 20 volume % of the vapor and preferably 5 to 10 volume %. The rest of the vapor is passed to additional recovery means (not shown) via lines 35 and 56 and then to solvent storage or recycled back to the extraction zone (not shown). Rectification zone 94 is a small fractionating column containing packing and serves to fractionate the water out of the NMP/water/gas mixture. The vapor enters column 94 via line 36 and the NMP is condensed to liquid in the column. Most of the water vapor leaves column 94 via line 58, along with the stripping gas, and is passed to condenser 96 wherein said water is condensed to liquid, but not the stripping gas. The water condensed therein is drawn off via line 40 and sent to knockout drum 98 wherein the stripping gas is separated from the water. Part of the water is sent to disposal via lines 43 and 42, while the rest of the water is returned to fractionating column 94 as reflux via line 44. This reflux serves to fractionate the water out of the NMP/water/gas mixture ascending said column, so that the water leaving condenser 96 contains less than about 1 LV% NMP and typically less than about 0.5 LV% NMP. The liquid NMP and water which are condensed from the vapor to the liquid state and separated from the water which goes overhead in tower 94, are either returned to solvent drum 92 via lines 50 and 52 or run back into line 56 via lines 50 and 54 downstream of the point at which the vapor is drawn off via line 34. Alternatively, column 94 may be mounted directly on line 34, thereby eliminating the need for lines 36, 50 and 52 or 54. The stripping gas leaves condenser 96 via line 40 and is withdrawn from the system via line 41. Depending upon the composition of the stripping gas, it is either sent to the atmosphere, to a flare, burned as fuel, or recycled back into the process. Fractionating column 94 normally operates at pressures and temperatures of from about 10 to about 40 psig and 220 to 400° F, while condenser 96 typically operates at temperatures of from about 80 to about 150° F and pressures 0.5 to 7 psi lower than the inlet of column 94.

PREFERRED EMBODIMENT

Referring to the drawing, about 5100 moles per hour of combined liquid and vapor at a temperature of 400° F, a pressure of 32 psig and having a composition of 10.4 mole % water, 80.6 mole % NMP and 9.0 mole % nitrogen stripping gas are passed to condenser 90 via line 30. Condenser 90 produces a mixed stream of liquid and vapor at a temperature of 325° F, which is then fed to hot solvent drum 92 via line 32. The liquid and vapor in drum 92 are at a temperature and pressure of 325° F and 30 psig, respectively. The liquid layer in drum 92 contains about 1.7 to 2.3 LV% water, with the remainder comprising NMP and minor quantities (typically less than 10 LV%) of dissolved oil. This liquid is continuously withdrawn from drum 92 via line 48 and is recycled back to the extraction zone (not shown). Overhead vapors from drum 92 are passed to line 34, about 7 volume % thereof are passed to packed tower 94 via line 36 and the remainder are passed to additional solvent recovery (condensing) means (not shown) via lines 35 and 56. These vapors are composed of 67.3 mole % NMP, 22.1 mole % water and 10.6 mole % nitrogen stripping gas. The 7% of the vapors passed through line 36 enter tower 94 wherein the NMP and some of the water in the vapors is condensed to the liquid state. This liquid NMP leaves tower 94 via line 50 at about 250° F and is returned either to drum 92 via lines 50 and 52, or is passed along to condensing means via lines 50, 54 and 56. The water vapor and stripping gas entering tower 94 pass through same to condenser 96 via line 58 wherein the water is condensed to the liquid state at a temperature of 130° F. The condensed water, along with the stripping gas are withdrawn from condenser 96 via line 40 and sent to knockout drum 98 wherein the stripping gas is separated from the water. About 60 LV% of the water is returned to tower 94 via lines 43 and 44 to act as reflux therein, while the remainder, containing less than 0.5 LV% NMP is set to disposal via lines 43 and 42. The stripping gas is withdrawn from knockout drum 98 via line 41. The amount of water removed from the system is about 13 barrels per day.

What is claimed is:

1. An improved process for removing minor amounts of water extraneously introduced into a lube oil extraction solvent comprising NMP and minor amounts of water, said process comprising removing most of said solvent from a lube oil extract, as a first solvent vapor, by flash evaporation, simple distillation, rectification or combination thereof and stripping residual solvent from said extract with a non-aqueous stripping gas to form a mixture of solvent vapor and stripping gas, separating said solvent from said gas and recovering said solvent, wherein the improvement comprises the steps of:

a. combining said first solvent vapor with said mixture;

b. passing said combined mixture which contains extraneous and non-extraneous water through a first condensing zone wherein most of the solvent in said mixture is condensed to a liquid to form a mixture of condensed solvent, stripping gas and vapor and wherein said vapor contains NMP and said extraneous water;

c. passing said second mixture to a separating zone to separate said condensed solvent from said vapor and stripping gas;

d. passing at least a portion of the separated vapor and stripping gas from said separating zone to a rectifying zone wherein said NMP in said vapor is condensed and separated from said extraneous water and stripping gas;

e. passing said extraneous water vapor and stripping gas from said rectifying zone to a second condensing zone to condense the extraneous water and separate same from the stripping gas; and f. returning a portion of said condensed water from the second condensing zone back to said rectifying zone to act as reflux therein.

2. The process of claim 1 wherein the stripping gas contains no more than 6 mole % water.

3. The process of claim 2 wherein the extraction solvent contains from about 0.5 to 10 LV% water based on the MNP content thereof.

4. The process of claim 3 wherein the stripping gas is nitrogen.

5. The process of claim 4 wherein from 50 to 90 mole percent of the water in the combined mixture passed to the first condensing zone is condensed to liquid in said zone.

6. The process of claim 5 wherein from 2 to 20 volume % of vapor and stripping gas from the separating zone is passed to the rectifying zone.

7. The process of claim 6 wherein said rectifying zone operates at a temperature and pressure ranging from about 220° to 400° F and about 10 to 40 psig, respectively.

8. The process of claim 7 wherein the extraneous water condensed in the second condensing zone contains less than 1 LV% NMP.

* * * * *